US005533893A

United States Patent [19]

Barelli et al.

[11] Patent Number: 5,533,893

[45] Date of Patent: Jul. 9, 1996

[54] WALKING-BEAM FURNACE FOR THE ACCELERATED HEATING OF BILLETS OR THE LIKE

[75] Inventors: Alfredo Barelli; Stefano DePlano, both of Genoa, Italy

[73] Assignee: Iritecna Societa per l'Impiantistica Industriale e l'Assetto del Territorio P.A., Genoa, Italy

[21] Appl. No.: 190,490

[22] Filed: Feb. 2, 1994

[30] Foreign Application Priority Data

Feb. 3, 1993 [IT] Italy ..... GE93A0005

[51] Int. Cl.[6] ..... F27D 3/00

[52] U.S. Cl. ..... 432/122; 432/127

[58] Field of Search ..... 432/122, 123, 432/124, 127

[56] References Cited

U.S. PATENT DOCUMENTS 4,025,298 5/1977 Tokitsu ..... 432/122

4,492,565 1/1985 Feroldi ..... 432/127

4,585,411 4/1986 Bocci et al. ..... 432/122

*Primary Examiner*—David A. Okonsky

*Attorney, Agent, or Firm*—Larson and Taylor

[57] ABSTRACT

Walking-beam furnace for the accelerated heating of billets or the like, in which the upper surfaces of the mobile beams (1) and of the fixed beams (1') are made up of billet-tipping ridges (5, 4) having profiles which interact during operation so as to cause rotation of the billets about their longitudinal axes as they advance through the furnace. According to the invention, the billet-tipping ridges (4, 5) of the fixed beams (1') and of the mobile beams (1) consist of a plurality of modular elements (7, 8, 9, 10) in the form of billet-tipping ridge segments which are mutually aligned along the length of the beams (1, 1'). The ridge segments (7, 8, 9, 10) have additional features which improve operation of the billet-tipping ridges (4, 5).

11 Claims, 5 Drawing Sheets

WALKING-BEAM FURNACE FOR THE ACCELERATED HEATING OF BILLETS OR THE LIKE

The invention relates to a walking-beam furnace for the accelerated heating of billets or the like, in which the upper surfaces of the mobile beams and of the fixed beams are made up of billet-tipping ridges having profiles which interact during operation so as to cause rotation of the billets about their longitudinal axes, as they advance through the furnace.

The object of the invention is to improve a furnace of the type described at the beginning, in such a way that the billet-tipping ridges can be produced in a simpler and less expensive manner, are easily fitted and are quick and easy to maintain, and ensure improved operational characteristics, especially improved regulation of their heating up to the ideal temperature for treating billets and, therefore, greater furnace efficiency.

The invention achieves this object with a walking-beam furnace of the type described at the beginning, in which the billet-tipping ridges of the fixed beams and of the mobile beams consist of a plurality of modular elements in the form of billet-tipping ridge segments which are mutually aligned along the length of the beams.

The ridge segments are removably fixed on the top of the structure of the beams.

These measures mean that manufacture of the billet-tipping ridges is less complicated. Furthermore, fitting and maintenance of the billet-tipping ridges are considerably simplified and made quicker, more convenient and more cost effective, since it is possible to fit individual parts of reduced size and to replace only those segments which are damaged.

From a functional viewpoint, dividing the billet-tipping ridges into individual segments enables thermal expansion compensation joints to be created.

Preferably the ridge segments are fixed on top of coolant tubes which make up the upper part of the structure of the beams.

For this reason it is advantageous to have a beam in the form of a square tube which supports the ridge segments.

According to a further feature, the ridge segments have lateral recesses and/or through holes. The holes can be provided at such a height that they are completely or partially enveloped in a refractory lining of the structure of the beams or that they are located completely outside said refractory lining.

These measures allow improved regulation of the temperature of the billet-tipping ridges at the ideal values.

Furthermore, the surface of the ridge segments has transverse discharge grooves, especially at the points at which the billets bear.

This means that slag, for example oxides, does not accumulate at the points at which the billets bear.

The invention also relates to other features which further improve the walking-beam furnace described above and which are the subject of the subclaims.

The specific features of the invention and the advantages derived therefrom will emerge in greater detail from the description of certain preferred embodiments, illustrated by way of non limiting example in the appended drawings, in which:

FIGS. 1 and 2 respectively illustrate a side view and a transverse section of the support plane made up of fixed beams and mobile beams of a walking-beam furnace according to the invention.

Figure 1:
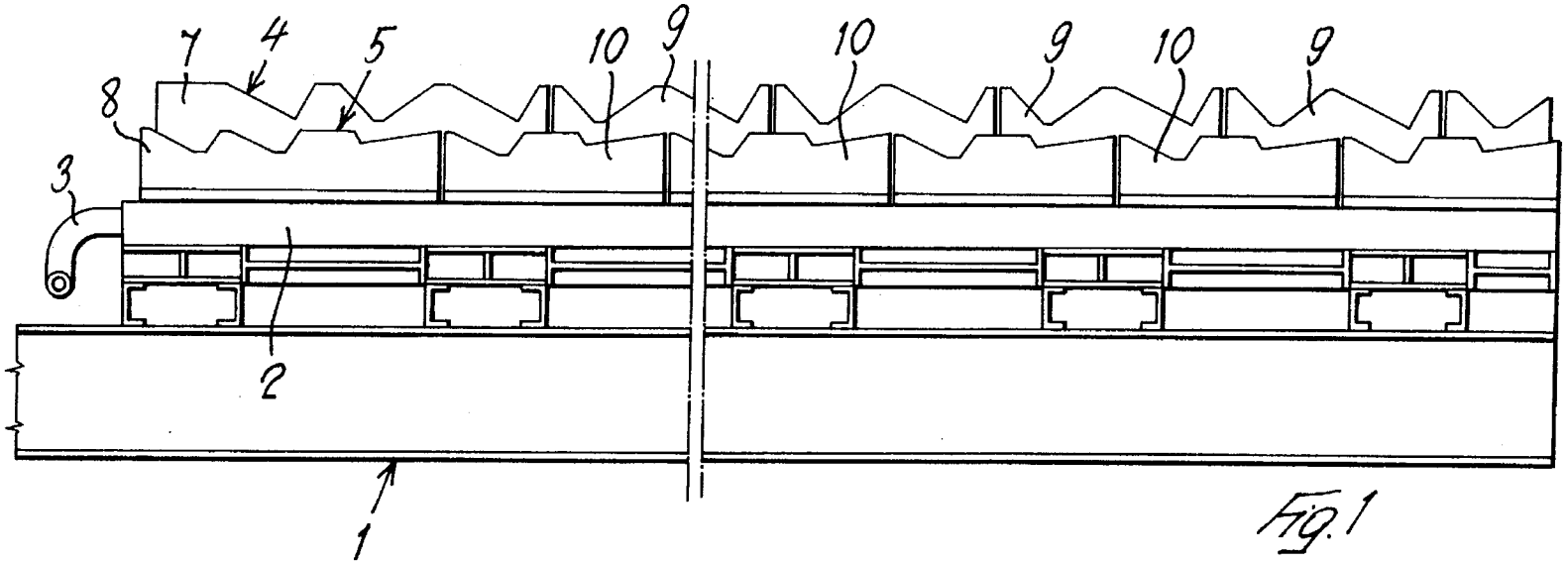
Figure 2:
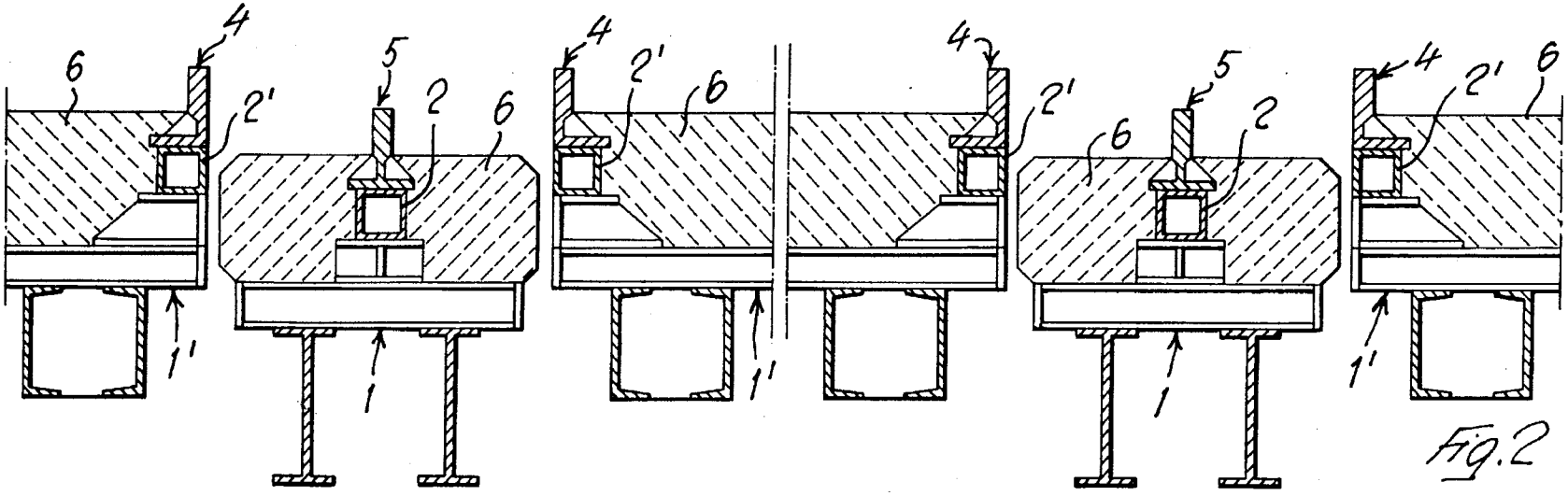

With reference to FIGS. 1 and 2, the reference numerals 1, 1' are used to indicate the structures of the mobile beams and of the fixed beams of a walking-beam furnace. The upper part of the structures of the beams 1, 1' is made up of a Square tube 2, 2', into which the coolant liquid is fed via a feed circuit, of which only the pipe union 3 which connects it to the square tube 2 of the structure of the mobile beam 1 is illustrated in FIG. 1. On the top of the square tube 2, 2' of the fixed beams 1' and of the mobile beams 1 are fixed billet-tipping ridges 4, 5 respectively which have a zigzag pattern, so that, in combination with each other, they cause the billets (not illustrated) to rotate about their longitudinal axes as they advance through the furnace. The top of the structure 1, 1' of the fixed and mobile beams, which faces the furnace chamber, is covered with a lining of refractory material 6, the upper surface of which extends to such a degree that it also partially covers the lateral walls of the billet-tipping ridges 4, 5, leaving unsupported [lacuna] of the billets.

The billet-tipping ridges 4 and 5 of the mobile beams and of the fixed beams are formed by a plurality of individual ridge segments which are aligned on the corresponding square tube 2, 2'. As is clear from FIG. 1, the profile of the billet-tipping ridges 4, 5 has an initial and a terminal part which has a different shape to that of the subsequent intermediate part. The profile of the latter is repeated cyclically and follows an identical shape. Thus, the billet-tipping ridges 4 and 5 are made up of initial and terminal ridge segments 7 and 8 and of a plurality of identical intermediate ridge segments 9 and 10.

Figure 3:
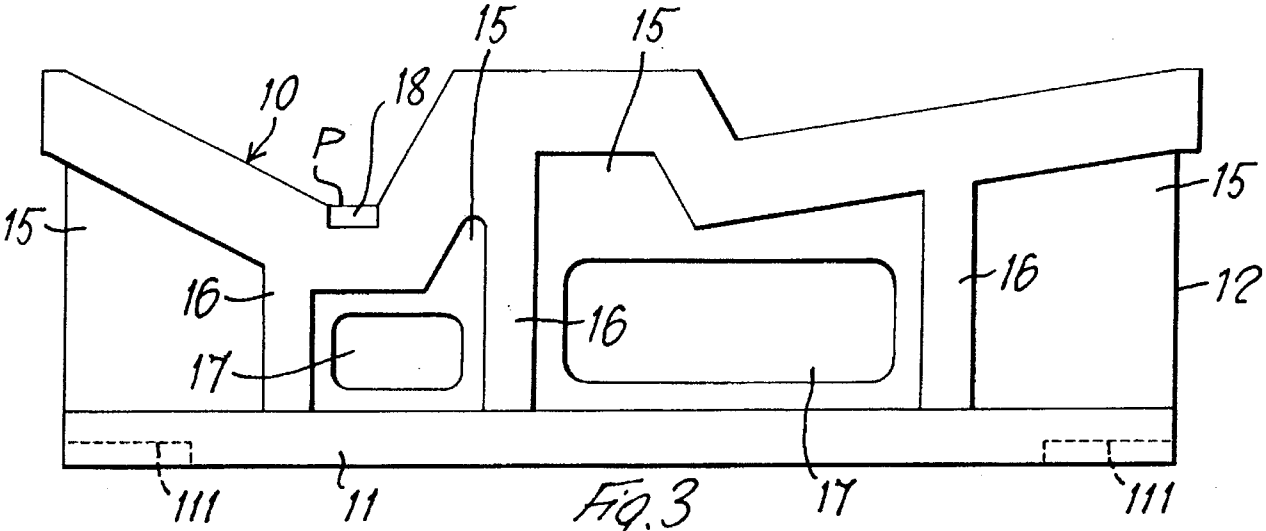
FIG. 3 is a side elevation of a first embodiment of a billet-tipping ridge segment associated with the mobile beams.
Figure 4:
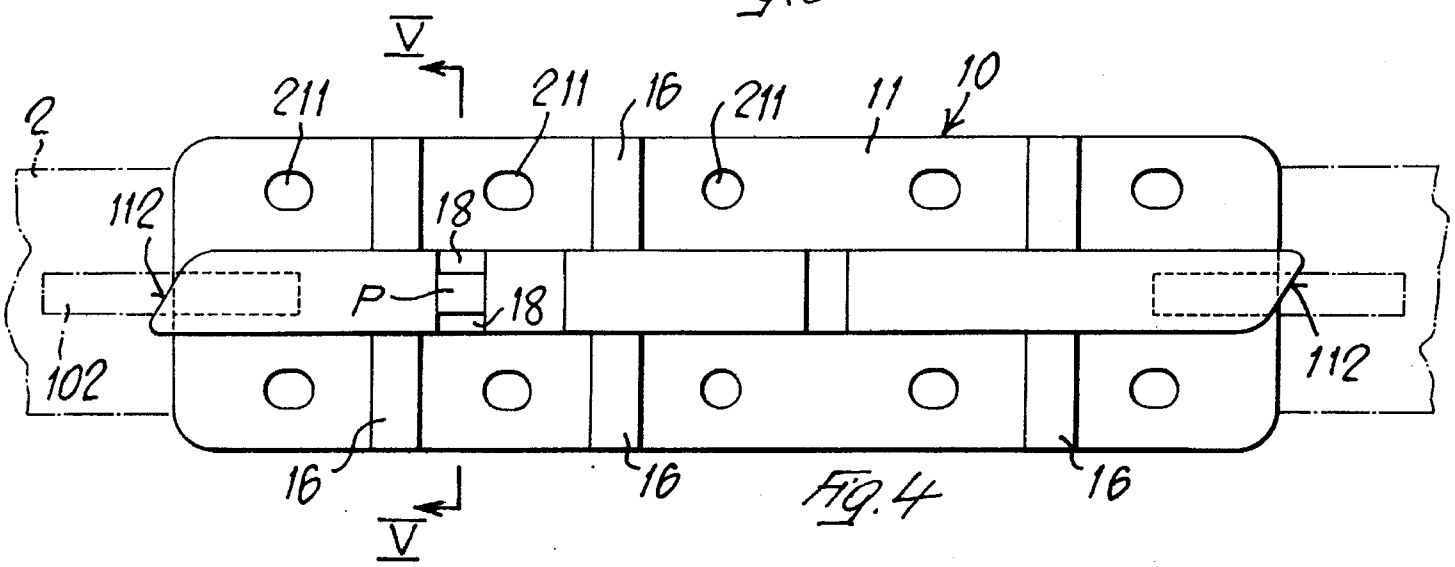
FIG. 4 is a plan view of the ridge segment according to FIG. 3.
Figure 5:
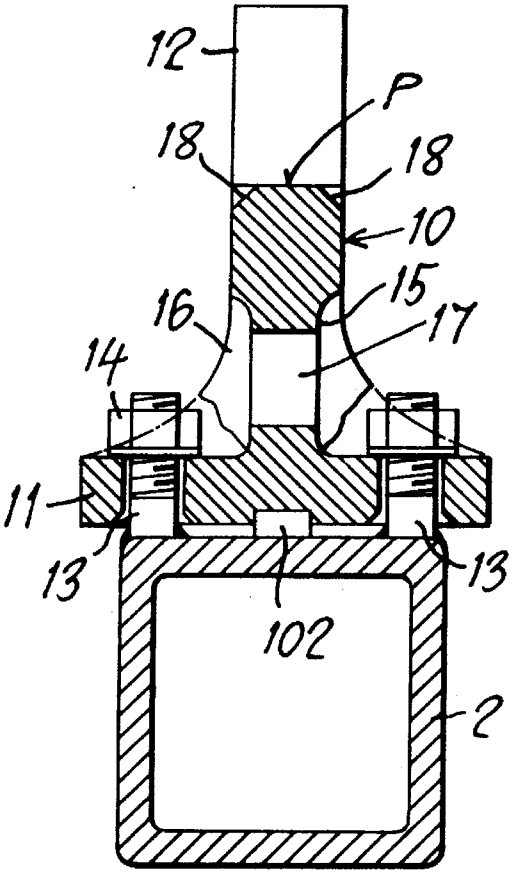
FIG. 5 is a transverse section of the ridge segment fitted onto the supporting square tube along the line V—V of FIG. 4.

FIGS. 3 to 5 show various views of one of the intermediate ridge segments 10 which form the intermediate part of the billet-tipping ridge 5 of the mobile beams. Apart from the fact that the profile of the ridge is different, the initial and terminal ridge segments are made in substantially the same way.

Each segment of the billet-tipping ridge 5 has a transverse section in the shape of an up-turned T, with a bearing foot 11 and a median, longitudinal, vertical leg 12, the top of which has a zigzag pattern and constitutes the surface on which the billets bear. The bearing foot 11 and the supporting square tube 2 are provided with complementary alignment means which in this case consist of a central longitudinal keyway 111 provided at the outermost ends of the foot 11 and of a complementary longitudinal key 102 on the top of the square tube 2. The keyways 111 can be open at the outermost ends of the foot 11 and engage with only half or a part of the key 102, the other half of which is intended to engage in the keyway 111 of the adjacent ridge segment 10 or 8. The ridge segments 10 and 8 are removably fixed to the square tube by means of studs 13 which are placed in two rows along the opposite lateral edges of the square tube 2 and which engage in corresponding holes 211 made in the foot 11, while the ridge segment 10, 8 is clamped onto the square tube by means of nuts or the like 14 which can be screwed onto the studs 13.

Weight-saving recesses 15, separated from each other by ribs 16 which also extend onto the top of the foot 11, terminating flush with said foot 11 at its lateral edges, are made on both sides of the vertical leg 12 of each ridge segment. In addition to the weight-saving recesses 15, the vertical leg 12 may be provided with through slots 17 of any shape or, optionally, even with one or more through holes 17' (FIG. 6) or with a plurality of through holes of small dimensions. The slots 17 and/or the through holes 17' may be provided at such a height that they are completely or partially enveloped by the layer of refractory lining 6. They may also be provided above the refractory lining 6. As well as reducing the weight and the amount of material used, the weight-saving recesses 15, the slots 17 and/or the holes 17' allow regulation of the transfer of heat through the ridge segment, thereby contributing to improved temperature regulation of the surface on which the billets bear.

According to a further feature, in order to allow slag and in particular oxides which are deposited at the points P at which the billets bear on the ridge segments 10, to be discharged, the upper surface of the vertical leg 12 which is shaped along its length has, at these points P, transverse grooves 18 at its lateral edges. The transverse grooves 18 extend lengthwise to a certain degree and are shaped for example by chamfering the lateral edges of the bearing surface.

A further feature of the ridge segments 10, 8 is that the outmost ends 112 of the vertical median leg 12 are made so that they are inclined parallel to each other with respect to the longitudinal axis, with one half of the terminal portion of the end of the leg 12 projecting out beyond the corresponding outermost end of the foot 11, whereas the other half slopes back with respect to said foot, so that the inclined outermost ends 112 of two adjacent ridge segments 10 fit flush together.

Figure 9:
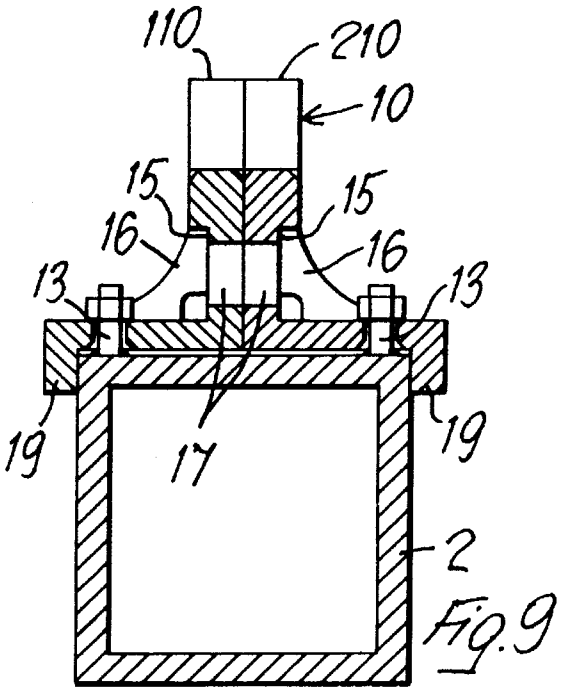
FIG. 9 is a transverse section of a ridge segment associated with the mobile beams and fitted onto the supporting square tube, according to a variant of the invention.

FIG. 9 illustrates a variant embodiment of a ridge segment 10 which is associated with the mobile beams. This variant embodiment differs from the embodiment shown in FIGS. 3 to 5, in that the ridge segment 10 is formed by two portions 110, 210 which are separate along the longitudinal, vertical, median plane. The two portions 110,210 have an L-shaped transverse section and are placed adjacent to each other. In addition, the means for aligning the ridge segments 10 onto the square tube 2 are formed by lower, vertical, longitudinal flanges 19, provided along the longitudinal edge of the bearing foot and which partially overlap the corresponding lateral wall of said square tube 2.

Figure 7:
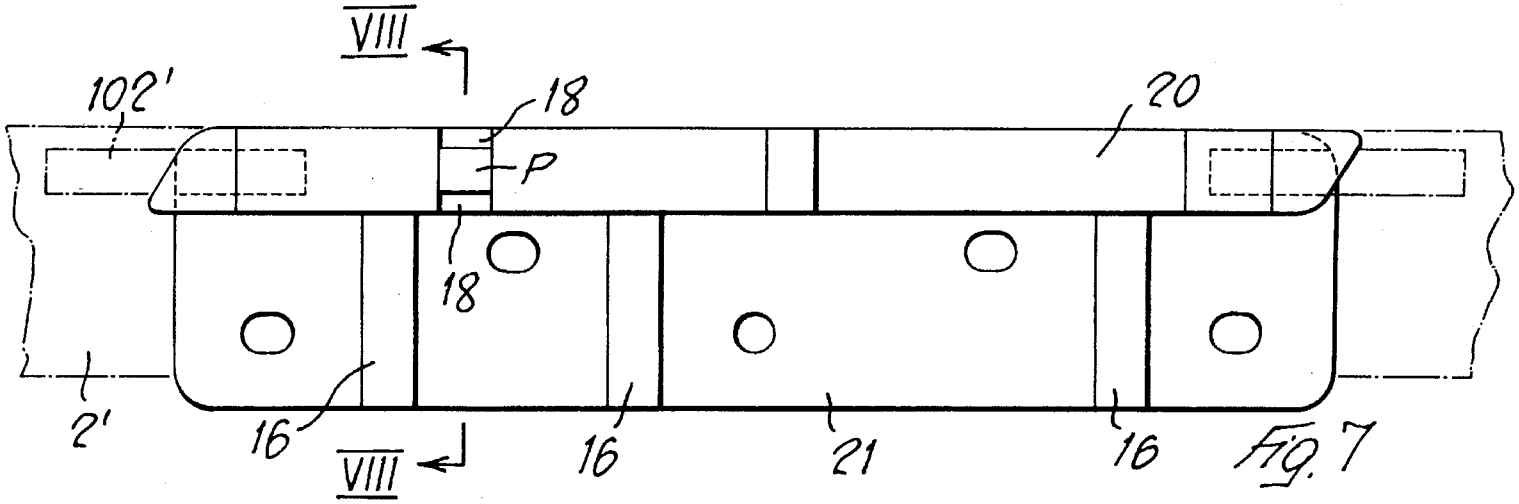
FIGS. 6 to 8 are similar views to those shown in FIGS. 3 to 5 of a billet-tipping ridge segment associated with the fixed beams.
Figure 8:
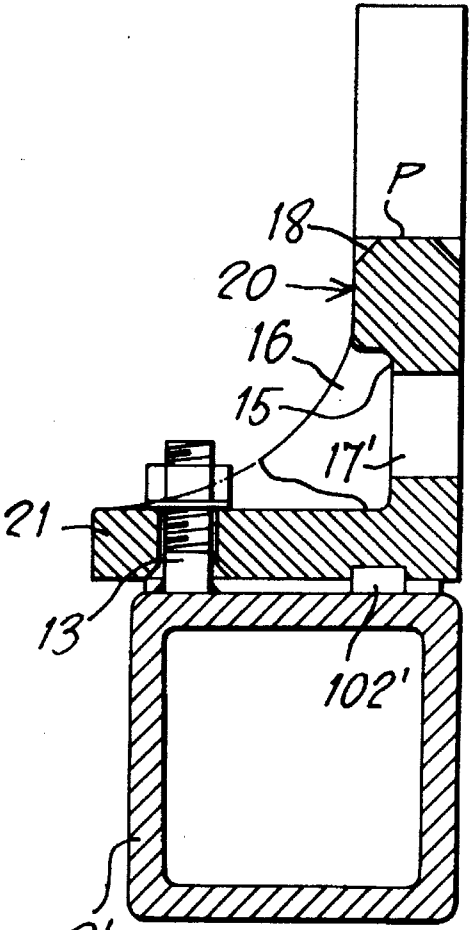
Figure 6:
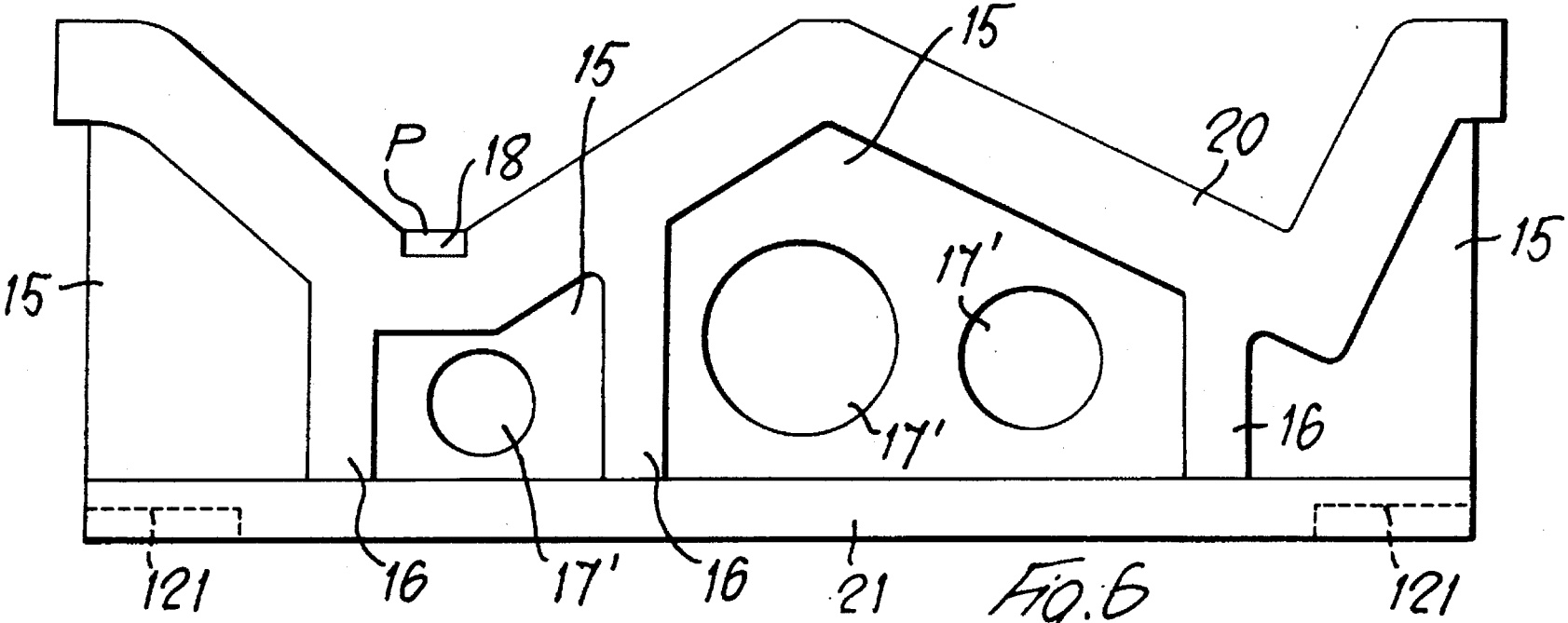

FIGS. 6 to 8 illustrate an embodiment of the intermediate ridge segments 9 which form the intermediate section of the ridges which are associated with the fixed beams. In this case also, the initial and terminal 7 ridge segment differs from the intermediate segments 9 only by virtue of the profile of the ridge itself.

The construction of the ridge segments 7 and 9 is substantially the same as that of the ridge segments 8 and 10 associated with the mobile beams and which has been described above.

The basic difference is that the vertical leg 20 is located along a longitudinal edge of the foot 21, thereby giving said ridge segments 9, 7 an L-shaped transverse section. In this case also, the ridge segments 7, 9 are provided with weight-saving recesses 15 separated by stiffening ribs 16 and with through holes 17'. The points P on which the billets bear have discharge grooves 18. The square tube 2=40 and the bearing foot 21 have complementary alignment means which can be formed by a keyway 121 and by a complementary key 102', or (not illustrated) by lateral vertical flanges as shown in the example of FIG. 9. The outermost ends 120 of the vertical leg 20 are also inclined with respect to the longitudinal axis and the ridge segments 7, 9 are again removably fixed to the square tube by means of lateral rows of studs 13.

According to a further feature, the ridge segments 7, 8, 9, 10 are made of special refractory alloys for example of the type known as UMCO (50% cobalt) and of a superalloy of Cr, Ni and Co.

We claim:

1. Walking-beam furnace for the accelerated heating of billets or the like comprising mobile beams and fixed beams, said mobile beams and fixed beams having upper surfaces made up of billet-tipping ridges (5,4) having profiles which interact during operation so as to cause rotation of the billets about their longitudinal axis as they advance through the furnace, characterized in that the billet-tipping ridges (4,5) of the fixed beams (1') and of the mobile beams (1) consist of a plurality of modular elements (7,8,9,10) in the form of billet-tipping ridge segments which are mutually aligned along the length of the beams (1,1') by means of studs (13) and provided with thermal expansion joints therebetween; said ridge segments being removably fixed on the top of the beam by means of studs (13), being fixed on tubular beams in the form of square tubes which form the pipes through which the assailant fluid passes and which are provided on the top of the structure of the beam, and being provided with complementary reciprocal positioning means.

2. Walking-beam furnace according to claim 1, characterised in that the ridge segments (7, 8, 9, 10) have through holes (17').

3. Walking-beam furnace according to claim 2, characterised in that the holes can be provided outside a refractory lining (6) which envelops the structure of the beams (1, 1') and partially envelops the ridge segments (7, 8, 9, 10).

4. Walking-beam furnace according to claim 1, characterised in that the ridge segments (7, 8, 9, 10) are made of refractory alloys containing 50% cobalt and of superalloys of chromium, nickel and cobalt.

5. Walking-beam furnace according to claim 1, characterised in that the ridge segments (8, 10) having a transverse section in the shape of an up-turned T may be made as a single piece.

6. Walking-beam furnace according to claim 1, characterised in that the upper surface of the ridge segments (7, 8, 9, 10) has transverse grooves (18) at the points (P) at which the billets bear.

7. Walking-beam furnace according to claim 6, characterised in that the transverse grooves 18 are provided on two opposite sides of the ridge segments (7, 8, 9, 10) and are formed by chamfered sections of the lateral edges of the upper surface of the ridge segments (7, 8, 9, 10).

8. Walking-beam furnace according to claim 1, characterised in that the ridge segments (7, 8, 9, 10) are made with a cross section in the shape of an up-turned T and comprise a foot (11) and a longitudinal, median, vertical leg.

9. Walking-beam furnace according to claim 8, characterised in that the weight-saving recesses (15) are separated from each other by stiffening ribs (16) which also extend onto the bearing foot (11, 21).

10. Walking-beam furnace according to claim 8, characterised in that the front and rear outermost ends (112, 120) of the vertical legs (12, 20) are made so that they are inclined parallel to each other with respect to the longitudinal axis.

11. Walking-beam furnace according to claim 10, characterised in that the terminal ends of the vertical legs (12, 20) extend, for the one part, beyond the corresponding outermost edge of the bearing foot (11, 21), and for the other part, slope back with respect to said foot.

* * * * *